US006299666B1

(12) United States Patent
Apostolidis et al.

(10) Patent No.: US 6,299,666 B1
(45) Date of Patent: Oct. 9, 2001

(54) METHOD FOR PRODUCING AC-225 BY IRRADIATION OF RA-226 WITH PROTONS

(75) Inventors: Christos Apostolidis, Heidelberg; Willem Janssens, Forst; Lothar Koch, Weingarten; John McGinley, Dettenheim; Roger Molinet; Michel Ougier, both of Linkenheim; Jacques van Geel, Ettlingen-Oberweier; Josef Möllenbeck, Leopoldshafen; Hermann Schweickert, Karlsruhe, all of (DE)

(73) Assignee: European Community (EC), Alcide de Gasperi (LU)

( * ) Notice: Subject to any disclaimer, the term of this patent is extended or adjusted under 35 U.S.C. 154(b) by 0 days.

(21) Appl. No.: 09/647,174

(22) PCT Filed: May 26, 1999

(86) PCT No.: PCT/EP99/03651

§ 371 Date: Sep. 27, 2000

§ 102(e) Date: Sep. 27, 2000

(87) PCT Pub. No.: WO99/63550

PCT Pub. Date: Dec. 9, 1999

(30) Foreign Application Priority Data

Jun. 2, 1998 (EP) ..... 98109983

(51) Int. Cl.[7] ..... C22B 60/02
(52) U.S. Cl. ..... 75/393; 376/125
(58) Field of Search ..... 75/393; 376/189, 376/170, 195

(56) References Cited

U.S. PATENT DOCUMENTS 4,088,532 5/1978 Blue ..... 176/11
5,355,394 * 10/1994 van Geel et al. ..... 376/189
5,885,465 * 3/1999 Bray et al. ..... 210/681

FOREIGN PATENT DOCUMENTS 0 752 709 1/1997 (EP) ..... G21G/1/06

OTHER PUBLICATIONS

Qaim, S.M., Target Development for Medical Radioisotope Production at a Cyclotron, INTDS & IAEA–INDC Conference on Heavy–Ion Targets and Related Phenomena, Darmstada, West Germany Sep. 5–9, 1988, vol. A282, No. 1, pp. 289–295.
XP000067681, Nuclear Instruments & Methods in Physics Research, Section A, Accelerators, Spectrometers, Detectors, and Associated Equipment), Oct. 1, 1989, Netherlands, p. 293, ¶3.3; figure 3.
Colmar, D., et al., *Biomedical Cyclotrons for Radioisotope Production*, Nuclear Medicine and Biology, vol. 13, No. 2, 1986, pp. 101–107.
Mausner L.F., et al., The Production of Spallation Radionuclides for Medical Applications at BLIP, 1982 IEEE Conference on the Application of Accelerators in Research and Industry, Denton, Texas, USA, Nov. 8–10, 1982, vol. 30, No. 2, pp. 1793–1796.
Database WPI, Section Ch. Week 9417, Derwent Publications Ltd., London GB; Class A14, AN 94–142414.

* cited by examiner

*Primary Examiner*—Ngoclan Mai
(74) *Attorney, Agent, or Firm*—Sughrue, Mion, Zinn, Macpeak & Seas, PLLC

(57) ABSTRACT

This invention refers to a method for producing Actinium-225, comprising the steps of preparing a target (1) containing Radium-226, of irradiating this target with protons in a cyclotron and of chemically separating Actinium from the irradiated target material thereafter. According to the invention the proton energy in the cyclotron is adjusted such that the energy incident on the Ra-226 is between 10 and 20 MeV, preferably between 9 14 and 17 MeV. By this means the yield of production of the desired isotope Ac-225 is enhanced with respect to other radioisotopes.

8 Claims, 1 Drawing Sheet

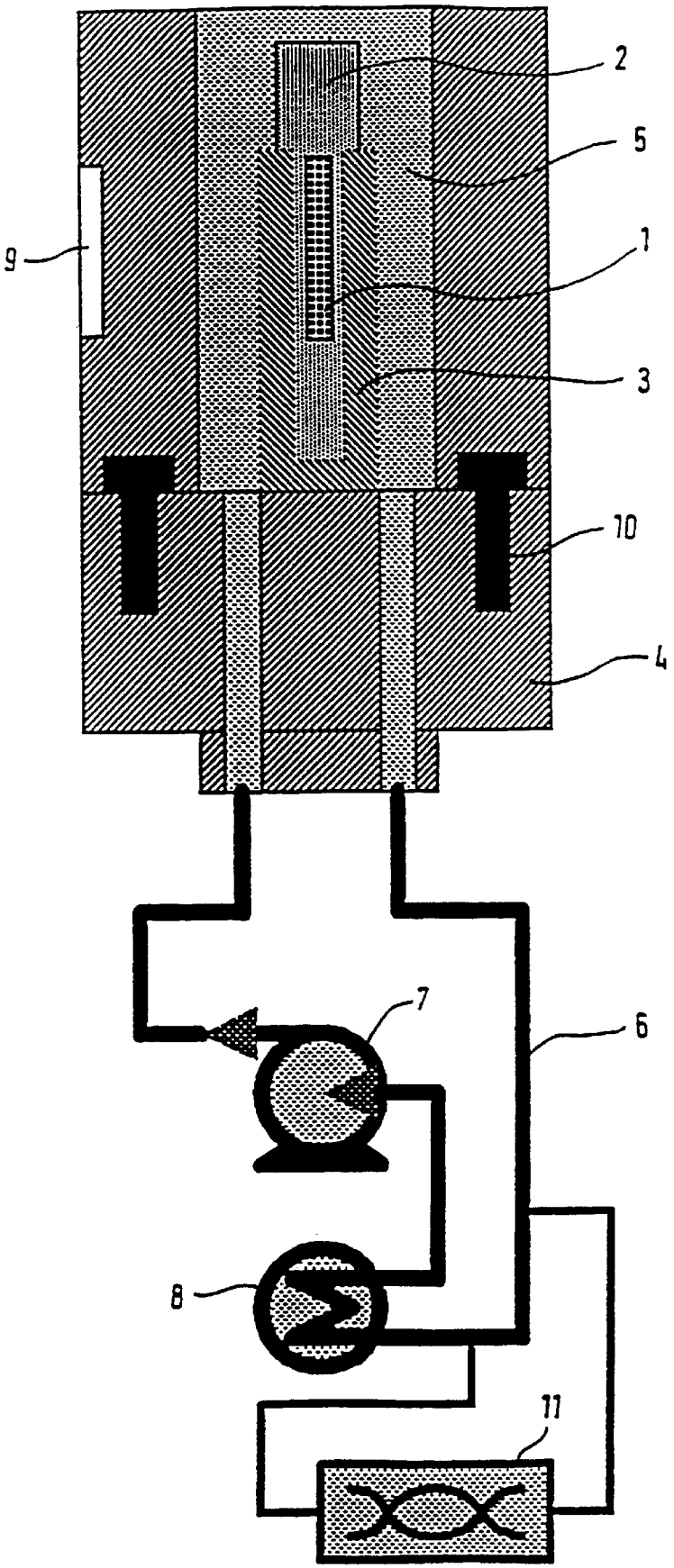
2
5
9
1
3
10
4
7
6
8
11

METHOD FOR PRODUCING AC-225 BY IRRADIATION OF RA-226 WITH PROTONS

The invention refers to a method for producing Ac-225, comprising the steps of preparing a target containing Ra-226, of irradiating this target with protons in a cyclo-tron and of chemically separating Ac from the irradiated target material. Such a method is known for example from EP-A-0 752 709.

According to this document the protons are accelerated in a cyclotron and are projected onto a target containing Ra-226 so that unstable radionuclei are transformed into Actinium by emitting neutrons. The possible nuclear reactions lead among others to Ac-226, Ac-225 and Ac-224.

Radio-immunotherapeutic methods for locally attacking cancer disease (metastases) become more and more important in view of progresses in immunology and radiotherapy and in the molecular biology field. Generally speaking, short half-life alpha-emitting nuclides are conjugated to a carrier (e.g. monoclonal antibodies) which after having been introduced into the patient body tend to be linked to and be integrated into malign cells and to destroy these cells due to an intense irradiation of very short range. The radionuclide must in this case cope with particular requirements: It must be apt to be linked for conjugation to a convenient antibody, it must have a convenient half-life and it should be readily available.

Among the possible candidates for such a radionuclide, Ac-225 and its daughter Bismuth-213 are preferred for radio-immunotherapy purposes (see for example EP-B-0 473 479). In the above cited document EP-A-0 752 709 it is described that the irradiation of Ra-226 by a proton beam results in the desired Ac-225 but also in considerable quantities of other highly undesired radionuclides, especially Ac-224 and Ac-226. In order to eliminate these undesired radionuclides said document suggests to delay the post-irradiation processing since the undesired nuclides cited above present a fairly short half-life compared with Ac-225 (half-life 10 days). Nevertheless this waiting period also leads to a considerable loss of Ac-225.

The invention proposes a method allowing to reduce or even eliminate this waiting period by a method supplying a higher yield and purity of the produced Ac-225. A further object of the invention is to produce Ac-225 by observing the safety regulations for handling the basic very radiotoxic material Ra-226 and the purity specifications of Ac-225 as required for the therapeutic use.

These objects are achieved by the method as claimed in claim 1. It has been found that the highest purity is achieved at an intermediate value of the proton impact energy of about 15 Mev.

Further improvements of the method as far as the preparation of the target, its irradiation and its final processing is concerned, are specified in the secondary claims.

The invention will now be described in more detail by means of a preferred embodiment and with reference to the enclosed drawings which show schematically a target assembly prepared to receive a proton beam from a cyclotron source.

The target nuclide is Ra-226 in the chemical form of $RaCl_2$ (Radiumchloride), obtained from precipitation with concentrated HCl, or radium carbonate $RaCO_3$. This material is then pressed in target pellets 1. Prior to irradiation these pellets are heated to above 150° C. in order to release crystal water therefrom before being sealed in a capsule 2 made of silver. The capsule is then mounted on a frame-like support 3 of a two-part casing 4 held together by screws 10.

The capsule is surrounded by a cooling space connected to an outer water cooling circuit 6. This outer circuit comprises a circulation pump 7 and a heat exchanger 8 for extracting the heat produced during irradiation in the capsule. The proton beam passes through a window 9 which is disposed in the wall of the casing 4 in face of the target 1. The square surface area of the target 1 which is hit by the beam may be for example about 1 $cm^2$.

It has been found that the distribution of the different produced Actinium isotopes depends largely upon the impact energy of the protons on the radium target nuclei. Table 1 shows experimental data on the production of different relevant radionuclides under irradiation of Ra-226 for 7 hours with a proton beam (10 $\mu$A) of variable impact energy. In this table the ratio Ra-224/Ra-226 is given instead of the ratio Ac-224/Ra-226. However Ra-224 is a daughter product of Ac-224 the latter having a short half-life of only 2.9 hours. This daughter product is particularly undesirable because one of its daughters is a gaseous alpha emitter (Rn-220) and another daughter Tl-208 is a high energy gamma emitter (2.615 MeV).

This table shows that the highest yield in Ac-225 is obtained at an intermediate value of the impact energy, globally situated between 10 and 20 MeV and preferably between 14 and 17 MeV. Of course, the proton current is adjusted as high as possible depending upon the cyclotron capability and the maximum heat load which can be carried away by the cooling circuit 6.

After irradiation, the target 1 is dissolved and then treated in a conventional way in order to separate Ac from Ra, for example in ion-exchangers.

The choice of silver for the capsule material is preferred for its high thermal conductivity which allows an efficient heat extraction, and for its inert chemical nature. The capsule provides a leak-tight seal for the highly radiotoxic material Ra-226, allows target processing after irradiation without introducing impurities into the medical grade product and avoids the introduction of unwanted cations which would interfere with the chelation of the radionuclides. Interactions between the target material and the silver capsule will not occur.

It is nevertheless advisable to monitor the leak-tightness in the cooling circuit 6 by an alpha monitor 11. Preferably an alpha-tight outer containment (not shown) surrounds the casing 4 and may further contain Radon traps.

TABLE 1

| Energy of protons incident on $^{226}Ra$ (MeV) | Yield of the relevant isotope (in activity percent with respect to Ra-226) | | | |
|---|---|---|---|---|
| | $^{225}Ra/^{226}Ra$ reaction: p,pn (activ %) | $^{224}Ra/^{226}Ra$ reaction: p,3n (activ %) | $^{225}Ac/^{226}Ra$ reaction: p,2n (activ %) | $^{226}Ac/^{226}Ra$ reaction: p,n (activ %) |
| 24.5 | 2.19 | 22 | 0.85 | |
| 20.1 | 1.09 | 47 | 4.55 | 2.1 |
| 15.2 | 0.22 | 4.5 | 15.00 | |
| 10.4 | 0.02 | 0 | 5.00 | 0 |
| 5.5 | 0.02 | 0 | 0.05 | 0 |

What is claimed is:

1. A method for producing Actinium-225, comprising the steps of preparing a target (1) containing Radium-226, of irradiating this target with protons in a cyclotron and of chemically separating Actinium from the irradiated target material, wherein the proton energy in the cyclotron is adjusted such that the energy incident on the Ra-226 is between 10 and 20 MeV.

2. A method according to claim 1, wherein the proton energy is adjusted such that the energy incident on the Ra-226 is between 14 and 17 MeV.

3. A method according to claim 1, wherein the target (1) consists of compressed pellets mainly made of radium chloride $RaCl_2$ or from radium carbonate $RaCO_3$.

4. A method according to claim 3, wherein the preparation of the target includes a step of heating the target material to a temperature above 150° C., in order to remove crystalline water.

5. A method according to claim 1, wherein in view of the irradiation, the target (1) is tightly sealed in a capsule (2) made of silver, this capsule being itself associated to a closed coolant fluid circuit (6).

6. A method according to claim 5, wherein the closed coolant fluid circuit (6) is equipped with an alpha monitor (11).

7. A method according to claim 5, wherein the capsule (2) and a casing (4) in which it is inclosed are installed in an alpha-tight cell.

8. A method according to claim 7, wherein the alpha-tight cell is equipped with a biological shielding and with radon traps.

* * * * *